US007302769B2

(12) United States Patent
Machala

(10) Patent No.: US 7,302,769 B2
(45) Date of Patent: Dec. 4, 2007

(54) INTERCHANGEABLE FAN ASSEMBLY FOR COLD-AIR INFLATABLE DISPLAYS

(75) Inventor: William Machala, Smithfield, RI (US)

(73) Assignee: Chrisha Creations, Ltd.RI (US)

( * ) Notice: Subject to any disclaimer, the term of this patent is extended or adjusted under 35 U.S.C. 154(b) by 425 days.

(21) Appl. No.: 10/789,748

(22) Filed: Feb. 27, 2004

(65) Prior Publication Data

US 2005/0190556 A1 Sep. 1, 2005

(51) Int. Cl.
*G09F 15/00* (2006.01)

(52) U.S. Cl. ..... 40/610; 446/179

(58) Field of Classification Search ..... None
See application file for complete search history.

(56) References Cited

U.S. PATENT DOCUMENTS

| | | | | |
|---|---|---|---|---|
| 2,748,256 | A | 5/1956 | Morgan | |
| 3,066,439 | A | 12/1962 | Lemelson | |
| 3,363,350 | A | 1/1968 | Moran | |
| 3,670,440 | A * | 6/1972 | Yost | 40/215 |
| 3,672,083 | A | 6/1972 | Moran | |
| 3,745,677 | A | 7/1973 | Moran | |
| 3,835,308 | A | 9/1974 | Reese | |
| 4,179,832 | A | 12/1979 | Lemelson | |
| 4,776,121 | A | 10/1988 | Vicino | |
| 4,995,186 | A | 2/1991 | Collie | |
| 5,125,177 | A * | 6/1992 | Colting | 40/610 |
| 5,215,492 | A | 6/1993 | Kubiatowicz | |
| 5,710,543 | A | 1/1998 | Moore | |
| 5,778,581 | A | 7/1998 | Bailey | |
| 6,012,826 | A | 1/2000 | Chabert | |
| 6,148,551 | A * | 11/2000 | Glass | 40/214 |
| 6,186,857 | B1 | 2/2001 | Gazit et al. | |
| 6,276,815 | B1 | 8/2001 | Wu | |
| 6,322,230 | B1 | 11/2001 | Medici | |
| 6,431,729 | B1 | 8/2002 | Chen | |
| 6,527,418 | B1 | 3/2003 | Scherba | |
| 6,572,247 | B2 | 6/2003 | Liu | |
| 6,644,843 | B2 | 11/2003 | Chin-Cheng | |
| 6,764,201 | B2 | 7/2004 | Chi-Cheng | |
| 2002/0089854 | A1 | 7/2002 | Liu | |
| 2002/0095831 | A1 | 7/2002 | Tsai | |

(Continued)

FOREIGN PATENT DOCUMENTS

| | | | |
|---|---|---|---|
| DE | 203 17 200 | U1 | 3/2004 |
| WO | WO 2005/107422 | A | 11/2005 |

OTHER PUBLICATIONS

Blowing deals is up their alley; Scherba's big inflatables Super Bowl Bound. (Inflatable Images, David and Bob Scherba); Suttle, Scott; Crain's Cleveland Business, v22, n4, p. 3; Jan. 22, 2001; ISSN: 0197-2375.

(Continued)

*Primary Examiner*—Joanne Silbermann
(74) *Attorney, Agent, or Firm*—Morgan & Finnegan, LLP

(57) ABSTRACT

An inflatable display that has an interchangeable fan assembly in a position on the inflatable figure that allows optimum airflow into the display. One interchangeable fan assembly can be used for a plurality of inflatable figures by detaching the interchangeable fan assembly from the receiving opening on one figure and attaching it to the same on another figure with a compatible receiving opening.

13 Claims, 5 Drawing Sheets

U.S. PATENT DOCUMENTS

2005/0190556 A1 9/2005 Machala

OTHER PUBLICATIONS

Globalock Corp.—dba American Inflatables—Crosses Into the New Millennium. Business Wire, p. 0149; Jan. 3, 2000.

Air Time: Inflatables Have Designs on Promotional Markets; Promo, v0, n0, p. 61; Sep. 1994; ISSN: 1047-1707.

Reaching New Heights. (Air Dimensional Design Inc. makes inflatable marketing tools); Greenberg, David; Los Angeles Business Journal, v23, n18, p. 19; Apr. 13, 2001.

* cited by examiner

One Fan

INTERCHANGEABLE FAN ASSEMBLY FOR COLD-AIR INFLATABLE DISPLAYS

FIELD OF THE INVENTION

The apparatus and method of the present invention relate to cold-air displays that maintain their inflated state through the use of continuously blowing electric fans.

BACKGROUND OF THE INVENTION

Inflatable displays have become increasingly popular in recent years. These types of displays have a wide range of application, shape and size, including, but not limited to, figures for holiday and seasonal decoration, marketing, advertising, entertainment, and event attraction. The inflatable displays are made from a permeable fabric that allows air to pass through the fabric at approximately the same rate as the air being blown into the inflatable display. The process of continuously blowing air being supplied from the fan occurring at substantially the same rate as air escaping the fabric allows the display to maintain its three-dimensional shape without the use of an internal or external frame or structure. These are known in the industry as "cold-air" inflatable displays.

Because most of these displays require a significant amount of airflow from the fan to maintain their inflated state, the fan assembly has been rather large and heavy and has been positioned at the bottom of the inflatable display adjacent the ground for support. A typical fan utilized in prior cold-air inflatable displays has a motor winding with sleeves and bearings configuration. Prior cold-air inflatable displays house the fan within a base positioned at the bottom of the figure into which the fan circulates blown air. Since the base housing the fan rests adjacent the ground, certain measures must be taken by the operator in order to ensure sufficient airflow into the fan. Specifically, the base housing the fan must be positioned at a height far enough above the ground to allow sufficient air to enter the fan. Permanently affixed legs or removable legs secured to the base have been utilized to raise the base housing the fan at a sufficient level above the ground enabling a proper airflow into the fan. If the fan is disposed too close to the ground, the flow of air into the fan may be limited and the figure may not be inflated in the manner desired. Thus, unacceptable inflation of the figure may result because the fan is positioned too low to the ground, or because the legs of the base sink further into the ground after it has already been positioned, or because unwanted debris accumulate between the fan and the ground.

The fan assemblies in prior inflatable displays also have been configured such that the fan assembly and/or the base which houses the fan are permanently affixed to the fabric of the inflatable figure in a variety of ways. For example, the fabric may be directly attached to the fan housing or base or secured to the fan housing or base via a fastening member. Further, because not all inflatable displays have the same shape on their bottom surfaces, the fan and base housing assemblies are unique for each type of display. Thus, in prior inflatable devices the fan assembly is a permanent component of each display. For example, if a consumer were to purchase a jack-o-lantern inflatable display for the Halloween season, a snowman inflatable display for the holiday season, and an Uncle Sam inflatable display for Independence Day, the consumer would be purchasing three complete packages of each inflatable figure, fan assembly, and other components. As the fan assembly is a significant cost component of inflatable devices, the lack of interchangeability between fan assemblies for different displays significantly increases the cost to purchasers of multiple inflatable devices. There is no present apparatus or method utilizing a fan assembly that is interchangeable with several different inflatable figure displays.

SUMMARY OF THE INVENTION

In the present invention, a cold-air inflatable display maintains its inflated state from one or more lightweight continuously blowing electric fan(s) positioned on the display in such a manner as to permit optimum airflow through the fan and into the display. The fan assembly is advantageously positioned on a lower portion of the display above the surface-touching bottom of the display so that the fan is elevated above the ground avoiding the problem of insufficient airflow into the display. This ensures that the airflow to the fan will not be limited preventing the fan from inflating the display with sufficient air pressure to properly maintain its shape. The positioning of the fan on a lower portion elevated above the ground further eliminates the need for a base housing for supporting the fan and legs for elevating the fan and base housing above the ground.

The invention also includes an interchangeable fan assembly that can be utilized with multiple displays, thus reducing cost to purchasers and increasing their ability to enjoy the benefits of numerous inflatable displays. By affixing the fan assembly to a standard-sized piece of fabric that is detachable from one display and reattachable to another display by joining the male fastening device of the standard-sized piece of fabric with the female fastening device of the other display, a fan assembly can be incorporated and used with any given number of comparable displays. Since the fan assembly is not positioned on the surface-touching bottom of the display, there is no difficulty finding a specified location on the lower portion of each display that allows for a convenient location for the fan assembly ensuring optimum airflow into the display.

It will be appreciated by those skilled in the art that the foregoing brief description and the following detailed description are exemplary and explanatory of this invention, but are not intended to be restrictive thereof or limiting of the advantages which can be achieved by this invention. Thus, the accompanying drawings, referred to herein and constituting a part hereof, illustrate preferred embodiments of this invention, and, together with the detailed description, serve to explain the principles of this invention.

BRIEF DESCRIPTION OF THE DRAWINGS

The features and advantages of the present invention, both as to its structure and operation, will be apparent from the following detailed description, especially when taken in conjunction with the accompanying drawings, wherein.

DETAILED DESCRIPTION OF THE INVENTION

Figure 1:
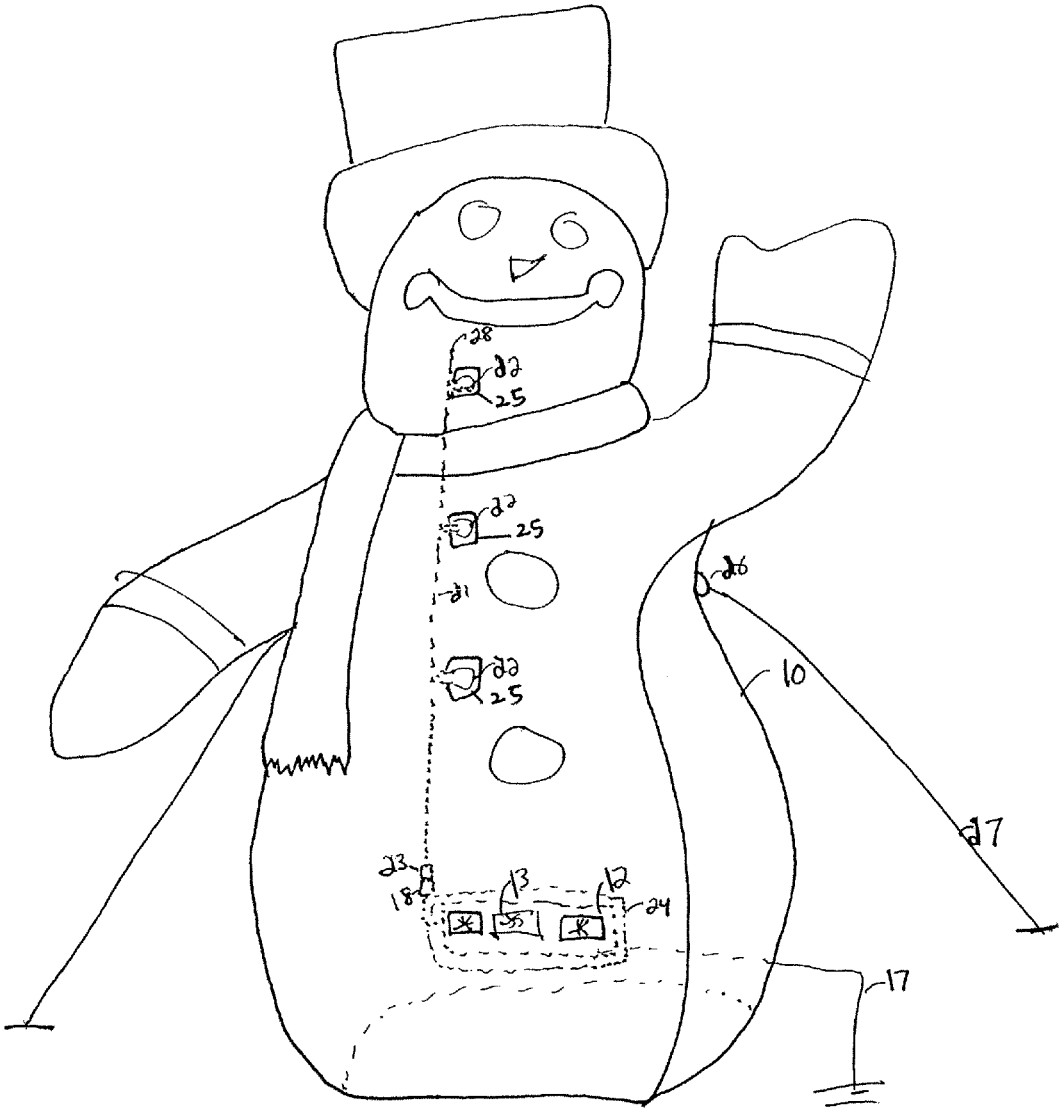
FIG. 1 is a front perspective view of an inflatable display with an embodiment of the interchangeable fan assembly of the present invention.
Figure 2:
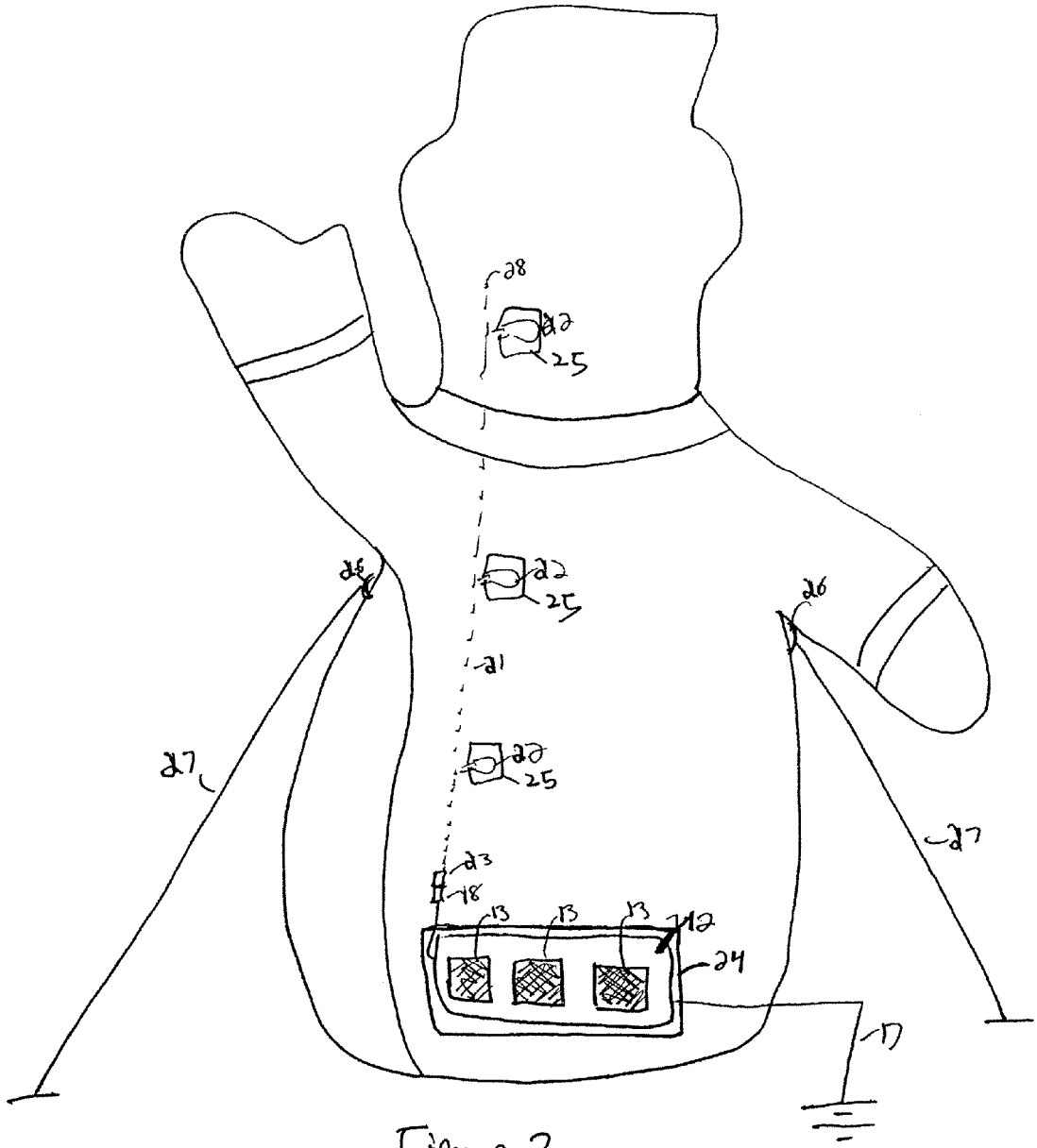
FIG. 2 is a back perspective view of an inflatable display with an embodiment of the interchangeable fan assembly of the present invention.

The apparatus and method of the present invention will now be discussed with reference to FIGS. 1, 2, 3, 4, and 5. Referring to FIGS. 1 and 2, inflatable display 10 includes interchangeable fan assembly 12, in this embodiment comprising three electric fans 13, female fastening device 24 for receiving said interchangeable fan assembly, interior lighting arrangement 21, and power source 17. The material of inflatable display 10 is preferably made from a permeable fabric that allows air to escape at approximately the same rate as air being blown into the inflatable display by said interchangeable fan assembly 12. Inflatable display 10, shown in this embodiment as a snowman, may be configured in any shape or size, depending on the specific need and purpose of the display. Inflatable display 10 is held in position by a securing mechanism, such as tether 27, that fastens to either the ground or another structure and is secured to said inflatable display by securing devices, such as securing ring 26 attached to inflatable display 10.

Interior lighting arrangement 21 includes one or more light bulbs 22 secured to a power cord 28. Protective covers 25 are secured around each light bulb to protect the permeable fabric of inflatable display 10 from heat produced from each bulb. Interior lighting arrangement 21 is attached to interchangeable fan assembly 12 through electrical connector 23 on the bottom end of power cord 28 that mates with electrical connector 18 of interchangeable fan assembly 12. When interchangeable fan assembly 12 is switched from one display to another, an operator detaches electrical connector 18 on interchangeable fan assembly 12 from electrical connector 23 on interior lighting arrangement 21.

Figure 3:
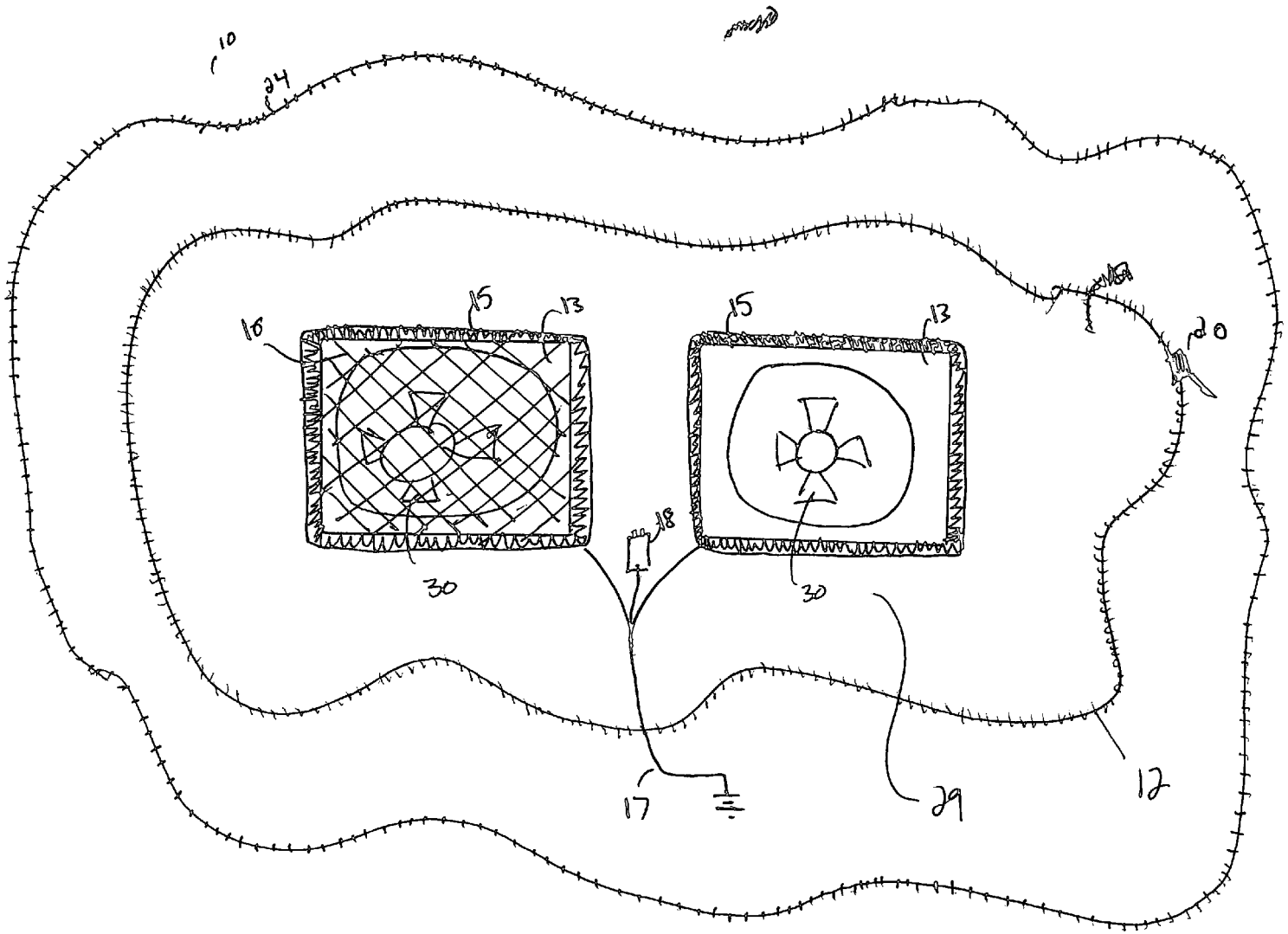
FIG. 3 is an enlarged view of an embodiment of the interchangeable fan assembly of the present invention.
Figure 4:
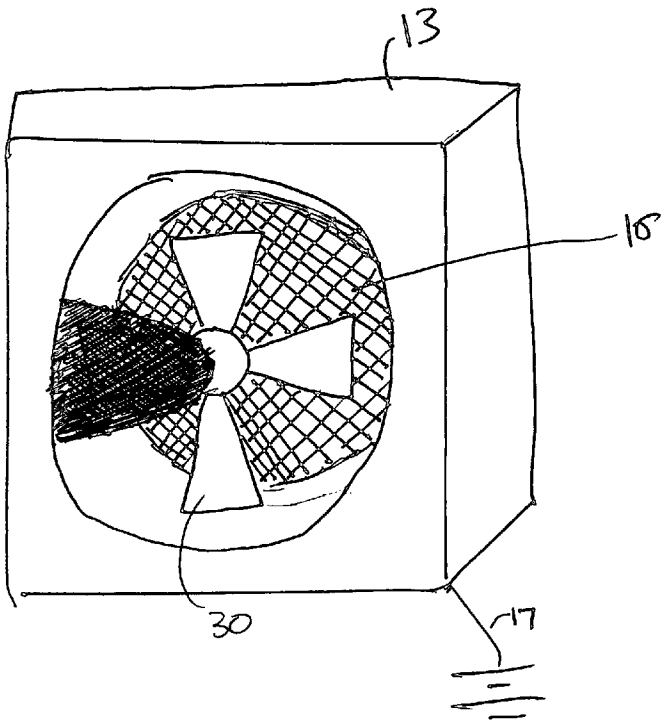
FIG. 4 is an enlarged view of an embodiment of a fan unit of the interchangeable fan assembly.

Referring now to FIGS. 3 and 4, interchangeable fan assembly 12 is comprised of one or more electric fans 13 connected to power source 17 and electrical connector 18. The housing of electric fan 13 is secured to standard-sized fabric 29 by fastening frame 15 sewn into standard-sized fabric 29. Fastening frame 15 borders the housing of electric fan 13 thereby securing the fan to standard-sized fabric 29 and holding the fan in place.

Electric fan 13 is preferably a lightweight plastic sleeveless bearing fan. The lightweight of the electric fan assembly and the plastic housing enables the fan assembly to be secured to the fabric of the inflatable display at a position elevated above the surface-touching bottom of the display without distorting the shape of the inflatable display and without the need for a base to support and elevate the fan above the ground to achieve sufficient air intake. Electric fan 13 can be easily removed from its housing 15 for cleaning or replacement whenever necessary. Electric fan 13 is covered with safety grill 16 to guard against unwanted debris from entering the display as well as contacting fan blades 30. Around the edge of standard-sized fabric 29 is male fastening device 20 for attaching interchangeable fan assembly 12 through a receiving opening to female fastening device 24 of inflatable display 10. Male fastening device 20 for attaching interchangeable fan assembly 12 to female fastening device 24 is illustrated in the preferred embodiment to comprise a zipper system, but other means of attachment such as fasteners, buttons, hook and loop fastening tape, or the like can be used.

Figure 5:
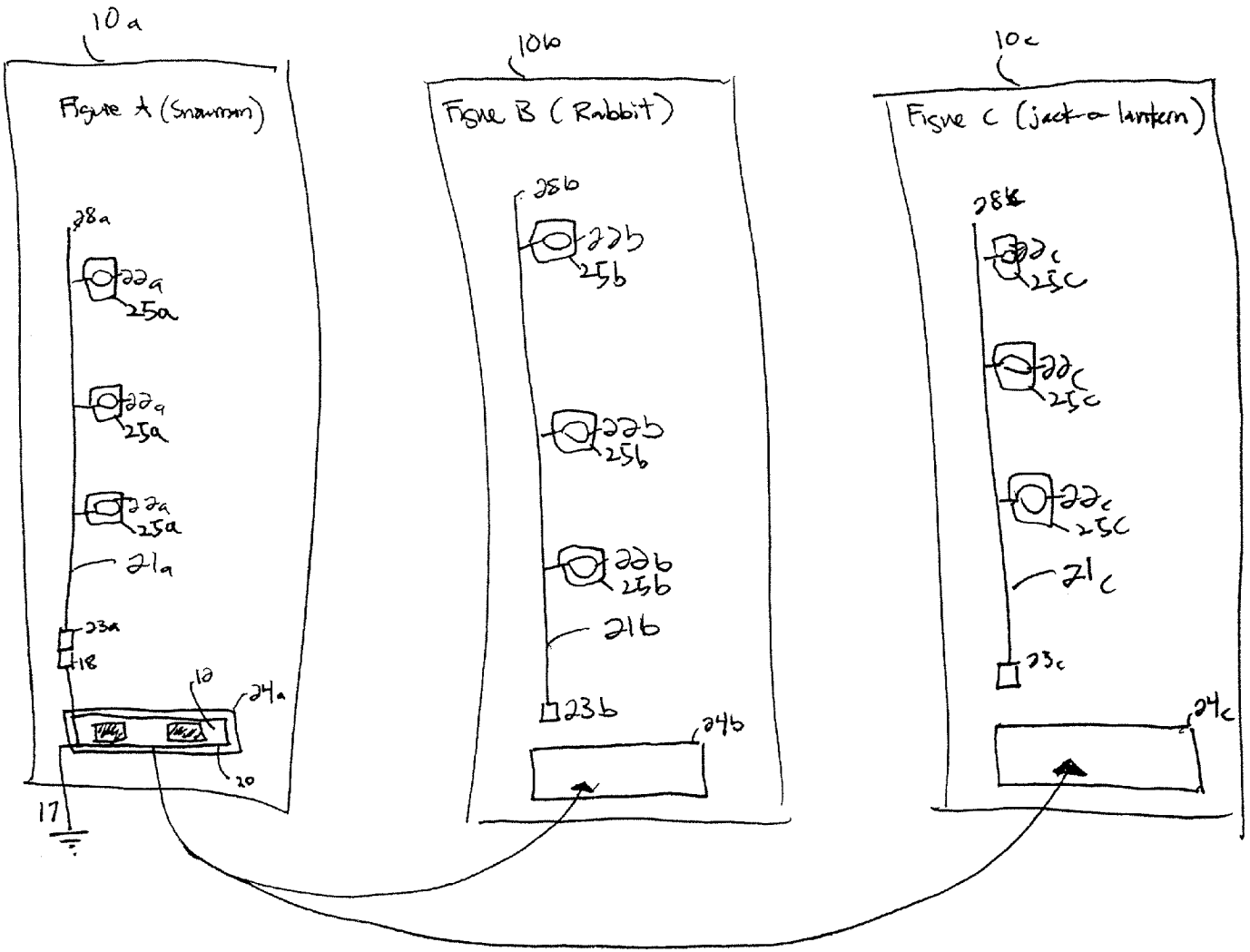
FIG. 5 is a block diagram illustrating an embodiment of a fan assembly from one inflatable display being interchanged with alternative inflatable displays configured to receive the fan assembly.

Referring now to FIG. 5, secured to inflatable display 10*a* is interchangeable fan assembly 12. User detaches interchangeable fan assembly 12 from female fastening device 24*a*, and then detaches electrical connector 18 from electrical connector 23*a*. Interchangeable fan assembly 12 can now be removed for insertion and use with another inflatable display 10*b* (or 10*c*) by attaching electrical connector 18 to electrical connector 23*b* (or 23*c*) and then securing interchangeable fan assembly 12 through a receiving opening to inflatable display 10*b* (or 10*c*) by joining male fastening device 20 to female fastening device 24*b* (or 24*c*). Interchangeable fan assembly 12 is secured to a standard-sized piece of permeable fabric fitted for attachment to either female fastening device 24*b* or 24*c* on inflatable display 10*b* or 10*c*, respectively.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

The invention claimed is:

1. A cold-air inflatable display comprising:

a permeable fabric forming an inflatable figure with a hollow body;

an interchangeable fan assembly for continuously-blowing air into said hollow body, said fan assembly comprising at least one fan, a housing for said fan secured to a piece of fabric having a male securing device disposed along a border of said standard-sized fabric for receipt by a female securing device disposed along a border of a receiving opening joining said fan assembly to said permeable fabric through said receiving opening positioned on said hollow body above a surface-touching bottom to allow optimum airflow through said fan into said hollow body;

a lighting arrangement extending through an interior portion of said hollow body, comprising a power cord, at least one light fixture, including a light bulb with a protective cover, secured to said power cord and an electrical connector disposed at an end of said power cord mating with a second electrical connector extending from said fan assembly; and a second power cord extending from said fan for connection to a power source;

wherein said interchangeable fan assembly is a lightweight assembly elevated above said surface-touching bottom of said hollow body without a base support and without distorting said figure when said cold-air inflatable display is inflated.

2. The cold-air inflatable display of claim 1, further comprising three fans.

3. The cold-air inflatable display of claim 1, wherein said receiving opening has the same dimensions as the corresponding dimensions of said fan assembly.

4. The cold-air inflatable display of claim 1, further comprising a zipper system having a male securing zipper and a female securing zipper for joining said fan assembly to said permeable fabric.

5. The cold-air inflatable display of claim 1, further comprising a fastening frame for securing said housing of said fan to said piece of fabric.

6. A cold-air inflatable display, comprising:

a permeable fabric forming an inflatable figure with a hollow body;

an interchangeable fan assembly for continuously-blowing air into said hollow body, said fan assembly comprising at least one fan, a housing for said fan, a securing device disposed along a border of said housing for joining said fan assembly to said permeable fabric through a receiving opening positioned on said hollow body above a surface-touching bottom of said hollow body; and a lighting arrangement extending through an interior portion of said hollow body, comprising a power cord connected to said fan and at least one lighting element secured to said power cord;

wherein said interchangeable fan assembly is a lightweight assembly elevated above said surface-touching bottom of said hollow body without a base support and without distorting said figure when said cold-air inflatable display is inflated.

7. The cold-air inflatable display of claim 6, further comprising an electrical connector disposed at an end of said power cord mating with a second electrical connector extending from said fan assembly.

8. The cold-air inflatable display of claim 6, further comprising three fans.

9. The cold-air inflatable display of claim 6, wherein said receiving opening has the same dimensions as the corresponding dimensions of said fan assembly.

10. The cold-air inflatable display of claim 6, further comprising a zipper system having a male securing zipper and female securing zipper for joining said fan assembly to said permeable fabric.

11. The cold-air inflatable display of claim 6, further comprising a fastening frame for securing said housing of said fan to said fabric.

12. A method for interchanging a fan assembly for cold-air inflatable displays, comprising:

unfastening a border of an interchangeable fan assembly from a permeable fabric along a receiving opening positioned on a first cold-air inflatable display above a surface-touching bottom of said display, said interchangeable fan assembly is a lightweight assembly elevated above said surface-touching bottom without a base support and without distorting said first cold-air inflatable display when said first cold-air inflatable display is inflated;

removing an electrical connector extending from a fan of said interchangeable fan assembly from a second electrical connector of a power cord of a lighting arrangement of said first cold-air inflatable display;

connecting said electrical connector to a second power cord of a second lighting arrangement of a second cold-air inflatable display; and fastening said border of said interchangeable fan assembly to a second permeable fabric along a second receiving opening positioned on said second cold-air inflatable display above a surface-touching bottom of said display, said interchangeable fan assembly is a lightweight assembly elevated above said surface-touching bottom without a base support and without distorting said second cold-air inflatable display when said second cold-air inflatable display is inflated.

13. The method of claim 12, wherein said unfastening step comprises unzipping a male securing zipper from a female securing zipper along said receiving opening and said fastening step comprises zipping said male securing zipper together with a second female securing zipper along a second receiving opening.

* * * * *